US009442447B2

(12) United States Patent
Abe

(10) Patent No.: US 9,442,447 B2
(45) Date of Patent: Sep. 13, 2016

(54) IMAGE FORMING APPARATUS, METHOD THEREOF, AND COMPUTER PROGRAM PRODUCT

(75) Inventor: Yasuhiro Abe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 333 days.

(21) Appl. No.: 13/539,911

(22) Filed: Jul. 2, 2012

(65) Prior Publication Data

US 2013/0022364 A1 Jan. 24, 2013

(30) Foreign Application Priority Data

Jul. 20, 2011 (JP) ..... 2011-159166

(51) Int. Cl.
*G03G 15/16* (2006.01)
*G03G 15/00* (2006.01)
*G03G 15/01* (2006.01)

(52) U.S. Cl.
CPC ..... *G03G 15/5058* (2013.01); *G03G 15/0189* (2013.01); *G03G 15/1605* (2013.01); *G03G 2215/0129* (2013.01); *G03G 2215/0161* (2013.01)

(58) Field of Classification Search
CPC ..... G03G 15/1605; G03G 15/5058; G03G 2215/0161
USPC ..... 399/49, 72
See application file for complete search history.

(56) References Cited

U.S. PATENT DOCUMENTS

2005/0009351 A1* 1/2005 Takahashi et al. ..... 438/689
2007/0122210 A1* 5/2007 Sato et al. ..... 399/301
2010/0226695 A1* 9/2010 Sato et al. ..... 399/301
2012/0008154 A1 1/2012 Abe

FOREIGN PATENT DOCUMENTS

CN 1975603 A 6/2007
CN 101261465 A 9/2008
EP 0 943 969 A2 9/1999

(Continued)

OTHER PUBLICATIONS

Extended European Search Report issued Nov. 15, 2012 in Patent Application No. 12174943.6.

(Continued)

*Primary Examiner* — David Gray
*Assistant Examiner* — Thomas Giampaolo, II
(74) *Attorney, Agent, or Firm* — Oblon, McClelland, Maier & Neustadt, L.L.P

(57) ABSTRACT

An image forming apparatus includes image carriers; an exposing unit that forms latent images on the image carriers; a developing unit that develops the latent images with toners of different colors from each other; a first transfer unit that forms a color image by superimposing and transferring the developed images onto a second image carrier; a test pattern forming unit that forms, on the image carriers, test patterns to be transferred onto the second image carrier; and test pattern detection units capable of detecting the test patterns transferred onto the second image carrier in different positions from each other in a main-scanning direction. The test pattern forming unit selectively switches, depending on a width of the test patterns in the main-scanning direction, whether to form each of the test patterns in a position detectable by the corresponding one of the test pattern detection units.

14 Claims, 10 Drawing Sheets

(56) References Cited

FOREIGN PATENT DOCUMENTS

| | | |
|---|---|---|
| EP | 2 466 385 A1 | 6/2012 |
| JP | 11-102098 | 4/1999 |
| JP | 2008-250278 | 10/2008 |
| JP | 2009-169031 | 7/2009 |

OTHER PUBLICATIONS

Office Action and Search Report issued Jul. 25, 2014, in Chinese Patent Application No. 201210252066.0, filed Jul. 19, 2012 (w/English language translation).

* cited by examiner

IMAGE FORMING APPARATUS, METHOD THEREOF, AND COMPUTER PROGRAM PRODUCT

CROSS-REFERENCE TO RELATED APPLICATIONS

The present application claims priority to and incorporates by reference the entire contents of Japanese Patent Application No. 2011-159166 filed in Japan on Jul. 20, 2011.

BACKGROUND OF THE INVENTION

1. Field of the Invention

The present invention relates to an image forming apparatus, a method thereof, and a computer program product.

2. Description of the Related Art

In apparatuses such as a copying machine and a multi-function peripheral (MFP) that houses a plurality of functions such as copy, facsimile, and printer functions in one housing, image adjustments such as a color shift correction and a density correction are performed by forming test patterns on an intermediate transfer belt with a toner, and then by detecting the test patterns with a plurality of sensors. The sensors detecting the test patterns are placed at locations at which main-scanning positions of the sensors are different from each other, and the test patterns are formed at locations on the intermediate transfer belt where the sensors can detect the test patterns.

In addition, in order to reduce time (down time) during which a printing operation cannot be performed due to the image adjustment, the image adjustment is performed by forming the test patterns at both ends outside a main-scanning image area concurrently with the printing operation.

However, in the above-described method in which the test patterns are formed at both ends outside the main-scanning image area concurrently with the printing operation, the sensors for detecting the test patterns need to be placed at outer ends of the image area. In addition, in the case of forming test patterns having a large width in a main-scanning direction, a laser diode (LD) needs to emit light outside an optical properties guarantee area of an LD scanning optical system. Thus, there is a problem that operational trouble or image degradation is caused by, for example, exposure of an unintended place to flare light.

Here, the term "optical properties guarantee area" refers to an area in a main-scanning direction in which a scanning beam is guaranteed to be emitted to a target area of a photosensitive element. Outside this area, lens properties of the scanning optical system are not guaranteed, and when the beam is turned on, exposure of an unintended place occurs. When the unintended exposure occurs in the photosensitive element, the exposure causes occurrence of troubles such as a failure in an adjusting operation and image degradation, or, when the unintended exposure occurs in a sensor such as a synchronization detector, the exposure causes occurrence of operational abnormalities.

In order to reduce the down time due to the image quality adjustment, Japanese Patent Application Laid-open No. 2009-169031 discloses a method in which patterns are formed for sensors at the ends of the image. Furthermore, in order to detect patterns for detecting a positional deviation without fail, Japanese Patent Application Laid-open No. H11-102098 discloses a method in which a rough adjustment is first performed by roughly making correction with large shaped patterns, and then a fine adjustment is performed by finely making correction with small shaped patterns.

However, the technique described in Japanese Patent Application Laid-open No. 2009-169031 merely forms the patterns at the outer ends of the image area at the same time when the image is formed, and does not form patterns for sensors inside the image area. Thus, the patterns formed for the sensors at the ends of the image are situated outside the optical properties guarantee area. That is, a light source emits light outside the optical properties guarantee area. In the technique described in Japanese Patent Application Laid-open No. H11-102098, too, the light source emits light outside the optical properties guarantee area, depending on the size of the patterns formed and the locations of the sensors.

Therefore, there is a need for an image forming apparatus and a method thereof that are capable of suppressing the light source from emitting light outside the optical properties guarantee area.

SUMMARY OF THE INVENTION

According to an embodiment, there is provided an image forming apparatus that includes a plurality of image carriers; a charging unit that charges the image carriers; an exposing unit that forms latent images on the image carriers; a developing unit that develops the latent images formed on the image carriers with toners of different colors from each other; a first transfer unit that forms a color image by superimposing and transferring the images developed on the image carriers onto a second image carrier moving in transfer positions facing the image carriers; a second transfer unit that transfers the images transferred to and formed on the second image carrier onto a transfer material; a test pattern forming unit that forms, on the image carriers, test patterns to be transferred onto the second image carrier; a plurality of test pattern detection units that are capable of detecting the test patterns transferred onto the second image carrier in different positions from each other in a main-scanning direction; and a control unit that changes image forming conditions depending on detection results of the test patterns. The test pattern forming unit selectively switches, depending on a width of the test patterns in the main-scanning direction, whether to form each of the test patterns in a position detectable by the corresponding one of the test pattern detection units.

According to another embodiment, there is provided an image forming method performed in an image forming apparatus. The image forming apparatus includes a plurality of image carriers; a charging unit that charges the image carriers; an exposing unit that forms latent images on the image carriers; a developing unit that develops the latent images formed on the image carriers with toners of different colors from each other; a first transfer unit that forms a color image by superimposing and transferring the images developed on the image carriers onto a second image carrier moving in transfer positions facing the image carriers; a second transfer unit that transfers the images transferred to and formed on the second image carrier onto a transfer material; a test pattern forming unit that forms, on the image carriers, test patterns to be transferred onto the second image carrier; a plurality of test pattern detection units that are capable of detecting the test patterns transferred onto the second image carrier in different positions from each other in a main-scanning direction; and a control unit that changes image forming conditions depending on detection results of the test patterns. The image forming method includes determining a width of the test patterns in the main-scanning direction by the test pattern forming unit; and selectively switching, depending on the width of the test patterns, whether to form each of the test patterns in a position detectable by the corresponding one of the test pattern detection units, by the test pattern forming unit.

According to still another embodiment, there is provided a computer program product including a non-transitory computer-readable medium including a computer program executed on an image forming apparatus. The image forming apparatus includes a plurality of image carriers; a charging unit that charges the image carriers; an exposing unit that forms latent images on the image carriers; a developing unit that develops the latent images formed on the image carriers with toners of different colors from each other; a first transfer unit that forms a color image by superimposing and transferring the images developed on the image carriers onto a second image carrier moving in transfer positions facing the image carriers; a second transfer unit that transfers the images transferred to and formed on the second image carrier onto a transfer material; a test pattern forming unit that forms, on the image carriers, test patterns to be transferred onto the second image carrier; a plurality of test pattern detection units that are capable of detecting the test patterns transferred onto the second image carrier in different positions from each other in a main-scanning direction; and a control unit that changes image forming conditions depending on detection results of the test patterns. The program, when executed on the image forming apparatus, causes the image forming apparatus to perform determining a width of the test patterns in the main-scanning direction; and selectively switching, depending on the width of the test patterns, whether to form each of the test patterns in a position detectable by the corresponding one of the test pattern detection units.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
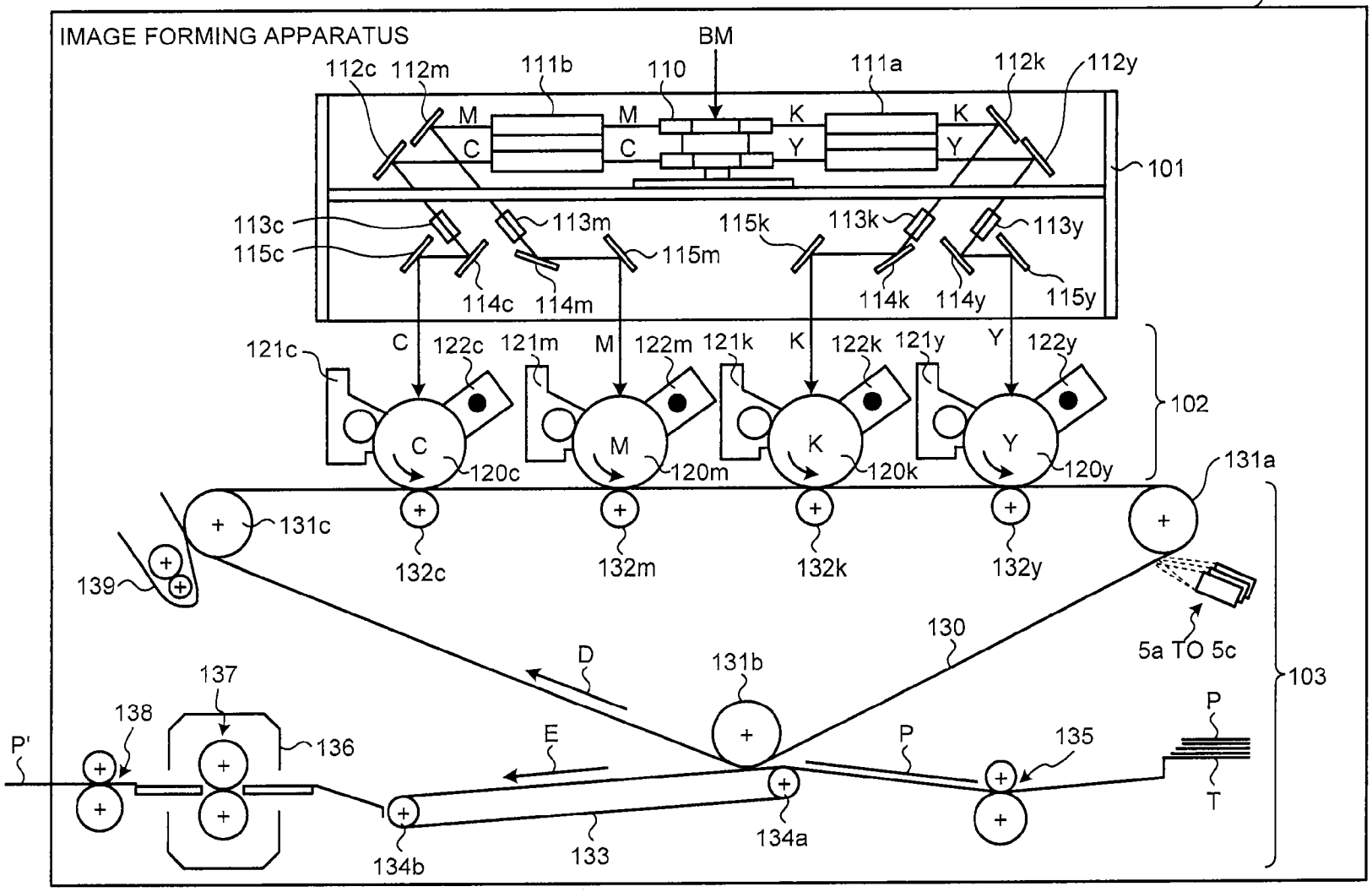
FIG. 1 is a diagram illustrating a configuration of an image forming apparatus according to an embodiment of the present invention.

An embodiment of an image forming apparatus according to the present invention will be described below in detail with reference to the accompanying drawings. FIG. 1 is a diagram illustrating a configuration of the image forming apparatus according to the embodiment of the present invention. This image forming apparatus 100 is an image processing apparatus including, for example, a facsimile apparatus, a printing apparatus (printer), a copying machine and an MFP, and is configured to include an optical device 101 that includes optical elements such as semiconductor laser light sources and a polygonal mirror; an image forming unit 102 that includes, for example, drum-like photosensitive elements (also called "photosensitive drums"), chargers, and developing units; and a transfer unit 103 that includes, for example, an intermediate transfer belt.

The optical device 101 deflects, with a polygonal mirror 110, light beams BM emitted from a plurality of light sources (omitted from illustration) that are semiconductor laser light sources including laser diodes (LDs), and inputs the deflected light beams to scanning lenses 111*a* and 111*b* that include fθ lenses. The light beams are generated such that the number of light beams corresponds to the number of images of each color yellow (Y), black (K), magenta (M), and cyan (C). The respective light beams are reflected by reflecting mirrors 112*y*, 112*k*, 112*m*, and 112*c* after passing through the scanning lenses 111*a* and 111*b*. For example, the yellow light beam Y is transmitted through the scanning lens 111*a*, then is reflected by the reflecting mirror 112*y*, and then enters into a WTL lens 113*y*. The same applies to the light beams K, M, and C having the colors black, magenta, and cyan, respectively, and therefore, description thereof will be omitted.

WTL lenses 113*y*, 113*k*, 113*m*, and 113*c* form the entered light beams Y, K, M, and C, respectively, and then, deflect the light beams Y, K, M, and C to reflecting mirrors 114*y*, 114*k*, 114*m*, and 114*c*, respectively. The light beams Y, K, M, and C are further reflected by reflecting mirrors 115*y*, 115*k*, 115*m*, and 115*c*, respectively, and projected in an image-like manner onto photosensitive drums (hereinafter called "photosensitive elements") 120*y*, 120*k*, 120*m*, and 120*c* as the respective light beams Y, K, M, and C used for exposure.

The light beams Y, K, M, and C are projected onto the photosensitive elements 120*y*, 120*k*, 120*m*, and 120*c* by using the multiple optical elements as described above. Therefore, timing synchronization is performed with respect to main-scanning directions and sub-scanning directions relative to the photosensitive elements 120*y*, 120*k*, 120*m*, and 120*c*. Hereinafter, the main-scanning directions relative to the photosensitive elements 120*y*, 120*k*, 120*m*, and 120*c* are defined as scanning directions of the light beams, and the sub-scanning directions relative to the photosensitive elements 120*y*, 120*k*, 120*m*, and 120*c* are defined as directions perpendicular to the main-scanning directions. That is, the sub-scanning direction is defined as the rotation direction of the photosensitive elements 120*y*, 120*k*, 120*m*, and 120*c*.

The photosensitive elements 120*y*, 120*k*, 120*m*, and 120*c* are each provided with a photoconductive layer, including at least a charge generation layer and a charge transport layer on a conductive drum made of, for example, aluminum. The photoconductive layers are respectively arranged corresponding to the photosensitive elements 120*y*, 120*k*, 120*m*, and 120*c*, and surface charges are given thereto by chargers 122*y*, 122*k*, 122*m*, and 122*c* configured to include a corotron, a scorotron, a charging roller, and the like.

The electrostatic charges provided on the photosensitive elements 120*y*, 120*k*, 120*m*, and 120*c* by the chargers 122*y*, 122*k*, 122*m*, and 122*c*, respectively, are exposed in an image-like manner to the light beams Y, K, M, and C, respectively. Accordingly, an electrostatic latent image is formed on a scanned surface of each of the photosensitive elements 120*y*, 120*k*, 120*m*, and 120*c*.

The electrostatic latent images respectively formed on the scanned surfaces the photosensitive elements 120*y*, 120*k*, 120*m*, and 120*c* are developed by developing units 121*y*, 121*k*, 121*m*, and 121*c*, respectively, each including, for example, a developing sleeve, a developer supplying roller, and a regulating blade. With this process, a developer image is formed on a scanned surface of each of the photosensitive elements 120*y*, 120*k*, 120*m*, and 120*c*.

The developers carried on the scanned surfaces of the photosensitive elements 120*y*, 120*k*, 120*m*, and 120*c* are transferred by primary transfer rollers 132*y*, 132*k*, 132*m*, and 132*c* corresponding to the photosensitive elements 120*y*, 120*k*, 120*m*, and 120*c*, respectively, onto an intermediate transfer belt 130 that is moved in the direction of arrow D by carriage rollers 131*a*, 131*b*, and 131*c*.

The intermediate transfer belt 130 is conveyed to a secondary transfer unit while carrying the developers of Y, K, M, and C thereon that have been transferred from the scanned surfaces of the photosensitive elements 120*y*, 120*k*, 120*m*, and 120*c*, respectively.

The secondary transfer unit is configured to include a secondary transfer belt 133 and carriage rollers 134*a* and 134*b*. The secondary transfer belt 133 is conveyed by the carriage rollers 134*a* and 134*b* in the direction of arrow E. The secondary transfer unit is supplied with an image receiving material sheet P such as high-quality paper or a plastic sheet by carriage rollers 135 from a sheet housing unit T such as a paper cassette. The secondary transfer unit transfers, by applying a secondary transfer bias, a multicolor developer image carried on the intermediate transfer belt 130 onto the sheet P that is attracted to and held on the secondary transfer belt 133. The sheet P is supplied to a fixing device 136 as the secondary transfer belt 133 is conveyed. The fixing device 136 is configured to include fixing members 137 such as fixing rollers that include, for example, silicone rubber and fluoro-rubber, and pressurizes and heats the sheet P and the multicolor developer image. Then, the sheet P is discharged by discharging rollers 138 as a printed matter P' out of the image forming apparatus 100.

After the multicolor developer image is transferred from the intermediate transfer belt 130, the residual developer after the transfer is removed from the intermediate transfer belt 130 by a cleaning unit 139 that includes a cleaning blade. Then, the intermediate transfer belt 130 is provided to the next image forming process.

Provided near the carriage roller 131*a* are three detection sensors 5*a*, 5*b*, and 5*c* for detecting pattern images (including a "test pattern image for color shift correction" and a "test pattern image for density correction") for correcting image forming conditions used when the color image is formed on the intermediate transfer belt 130. As the detection sensors 5*a*, 5*b*, and 5*c*, reflective detection sensors respectively including well-known reflective photosensors may be used. Based on detection results by the respective detection sensors 5*a*, 5*b*, and 5*c*, various deviation amounts of each color relative to a reference color are calculated, including a skew (inclination), a main-scanning registration deviation amount, a sub-scanning registration deviation amount, and a main-scanning magnification error; then, based on the calculation results, the various deviation amounts related to image quality adjustment are corrected; the image forming conditions (positional deviation correction and density correction) used when the color image is formed on the intermediate transfer belt 130 are corrected; and various processes related to generation of the test pattern images during image adjustment are executed.

Figure 2:
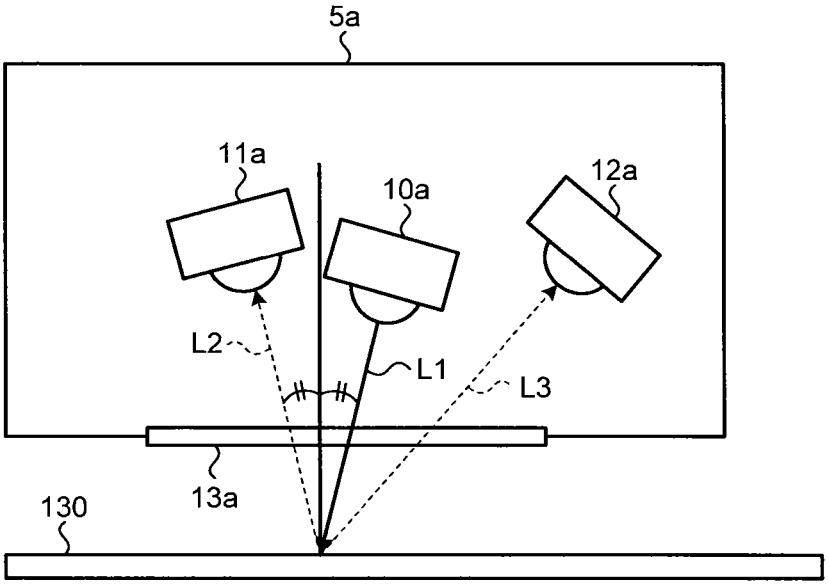
FIG. 2 is a diagram schematically illustrating a configuration of an inside of each of detection sensors of FIG. 1.

FIG. 2 is a diagram schematically illustrating a configuration of an inside of each of the detection sensors 5*a*, 5*b*, and 5*c* illustrated in FIG. 1. The detection sensors 5*a*, 5*b*, and 5*c* have common internal configurations. Although FIG. 2 illustrates the detection sensor 5*a*, the detection sensors 5*b* and 5*c* have the same internal configuration, and therefore, description thereof will be omitted.

The detection sensor 5*a* has one light-emitting element 10*a*, two light-receiving elements 11*a* and 12*a*, and a condenser lens 13*a*. The light-emitting element 10*a* is a light-emitting device that generates light, and is, for example, an infrared light LED that generates infrared light. The light-receiving element 11*a* is, for example, a specular reflection light-receiving element, and the light-receiving element 12*a* is, for example, a diffuse reflection light-receiving element.

In the detection sensor 5*a*, light L1 emitted from the light-emitting element 10*a* is transmitted through the condenser lens 13*a*, and then, arrives at a test pattern (omitted from illustration) on the intermediate transfer belt 130. Then, a part of the light is specularly reflected on a test pattern forming area and toner layers of the test pattern forming area to become specular reflection light L2, and then, after being transmitted through the condenser lens 13*a* again, is received by the light-receiving element 11*a*. Moreover, another part of the light is diffusely reflected on the test pattern forming area and the toner layers of the test pattern forming area to become diffuse reflection light L3, and then, after being transmitted through the condenser lens 13*a* again, is received by the light-receiving element 12*a*.

Note that as a light-emitting device, for example, a laser light-emitting element can be used instead of the infrared light LED. Note also that, although a phototransistor is used as each of the light-receiving elements 11*a* and 12*a* (the specular reflection light-receiving element and the diffuse reflection light-receiving element), an element composed of, for example, a photodiode or an amplifying circuit can also be used.

Figure 3:
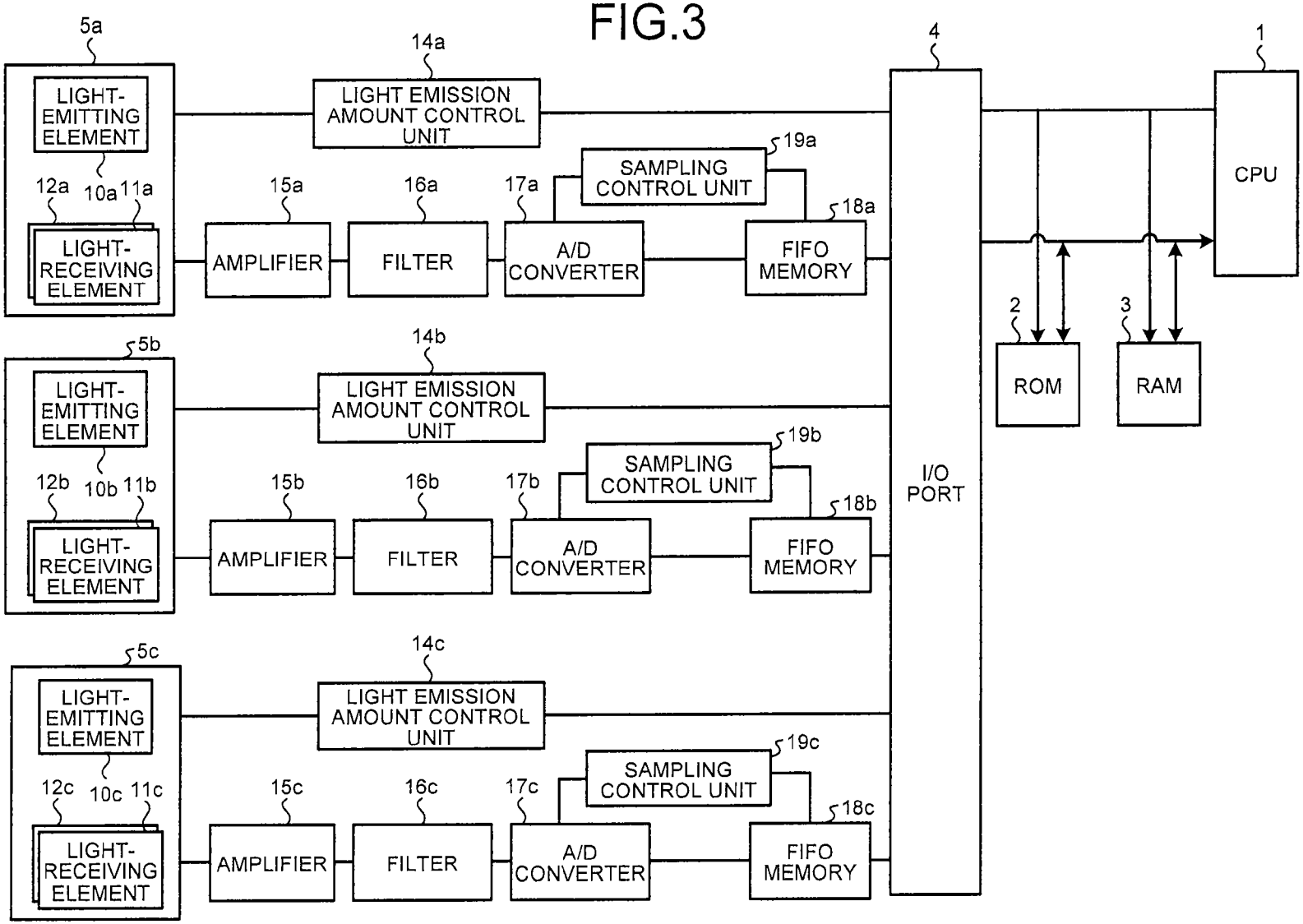
FIG. 3 is a block diagram illustrating internal configurations of the detection sensors and a configuration of functions in charge of processing data detected by the detection sensors.

FIG. 3 is a block diagram illustrating the internal configurations of the detection sensors 5*a*, 5*b*, and 5*c* of the image forming apparatus 100 and a configuration of functions in a controller of the image forming apparatus 100 that are in charge of processing data detected by the detection sensors 5*a*, 5*b*, and 5*c*. The detection sensors 5*a*, 5*b*, and 5*c* of the image forming apparatus 100 are provided with the light-emitting elements 10*a*, 10*b*, and 10*c*, and the light-receiving elements 11*a* and 12*a*, 11*b* and 12*b*, and 11*c* and 12*c*, respectively. Note that the condenser lenses 13*a*, 13*b*, and 13*c* illustrated in FIG. 2 are omitted from illustration in FIG. 3.

The controller of the image forming apparatus 100 is provided, as functional units related to processing of the data detected by the detection sensors 5*a*, 5*b*, and 5*c*, with a CPU 1, a ROM 2, a RAM 3, an input/output (I/O) port 4, light emission amount control units 14*a*, 14*b*, and 14*c*, amplifiers (AMPs) 15*a*, 15*b*, and 15*c*, filters 16*a*, 16*b*, and 16*c*, analog/digital (A/D) converters 17*a*, 17*b*, 17*c*, first-in-first-out (FIFO) memories 18*a*, 18*b*, and 18*c*, and sampling control units 19*a*, 19*b*, and 19*c*.

The ROM 2 stores therein various computer programs for controlling the image forming apparatus 100, including a computer program composed of procedures executed by the CPU 1 for performing various processes, including the correction process to correct the image forming conditions used when the color image is formed on the intermediate transfer belt 130, a positional deviation calculating process to calculate a positional deviation amount in the main-scanning direction occurring when the color image is formed on the intermediate transfer belt 130, and a pattern image correction process.

The CPU 1 monitors detection signals from the light-receiving elements 11*a*, 11*b*, and 11*c* at appropriate times, and the light emission amount control units 14*a*, 14*b*, and 14*c* control light emission amounts so that the signals can be detected without fail even if a conveying belt or the light-emitting element 10*a*, 10*b*, or 10*c* is, for example, degraded, thus keeping the levels of light-receiving signals from the light-receiving elements 11*a*, 11*b*, and 11*c* constant at all times. The RAM 3 is, for example, an NVRAM, and stores therein various parameters.

Next, the processing of the data detected by the detection sensors 5*a*, 5*b*, and 5*c* will be described with reference to FIG. 3. The CPU 1 executes the programs stored in the ROM 2 using the RAM 3 as a work area, and when a test pattern image is detected as will be described later in detail, controls the light emission amount control units 14*a*, 14*b*, and 14*c* via the I/O port 4, so as to respectively project predetermined light intensities of light beams from the light-emitting elements 10*a*, 10*b*, and 10*c* of the detection sensors 5*a*, 5*b*, and 5*c*, respectively.

First of all, the light beam emitted from the light-emitting element 10*a* of the detection sensor 5*a* will be described. The light beam is projected onto the test pattern image, and parts of light reflected therefrom are respectively received by the light-receiving elements 11*a* and 12*a* of the detection sensor 5*a*. The light-receiving elements 11*a* and 12*a* send data signals corresponding to respective light intensities of received light beams to the amplifier 15*a*. The amplifier 15*a* amplifies the data signals and sends them to the filter 16*a*. The filter 16*a* passes only a signal component of line detection out of the output signals from the amplifier 15*a*, and sends the passed signal component to the A/D converter 17*a*. The A/D converter 17*a* converts the output signal of the filter 16*a* from analog data to digital data. Then, the sampling control unit 19*a* samples the digital data converted in the A/D converter 17*a*, and stores the sampled data in the FIFO memory 18*a*.

In the same manner as described above, as for data signals obtained from the light-receiving elements 11*b* and 12*b* of the detection sensor 5*b*, sampled digital data is stored in the FIFO memory 18*b*, and as for data signals obtained from the light-receiving elements 11*c* and 12*c* of the detection sensor 5*c*, sampled digital data is stored in the FIFO memory 18*c*.

After the detection of the test pattern image is completed in this manner, the digital data items respectively stored in the FIFO memories 18*a*, 18*b*, and 18*c* are loaded into the CPU 1 and the RAM 3 via the I/O port 4 and data bus. Then, by executing the programs stored in the ROM 2, the CPU 1 performs a predetermined calculation process on the data items, and executes various processes, including the correction process to correct the image forming conditions used when the color image is formed on the intermediate transfer belt 130, the positional deviation calculating process to calculate the positional deviation amount in the main-scanning direction occurring when the color image is formed on the intermediate transfer belt 130, and the pattern image correction process.

In this manner, the CPU 1 and the ROM 2 control overall operation of the image forming apparatus 100 while serving as a control unit in charge of the processing of the data detected by the detection sensors 5*a*, 5*b*, and 5*c*, and also serving as a correcting unit, a positional deviation amount calculating unit, and a pattern image correcting unit. The CPU 1 and the ROM 2 also serve as a unit for disabling the pattern image correcting unit.

Figure 4:
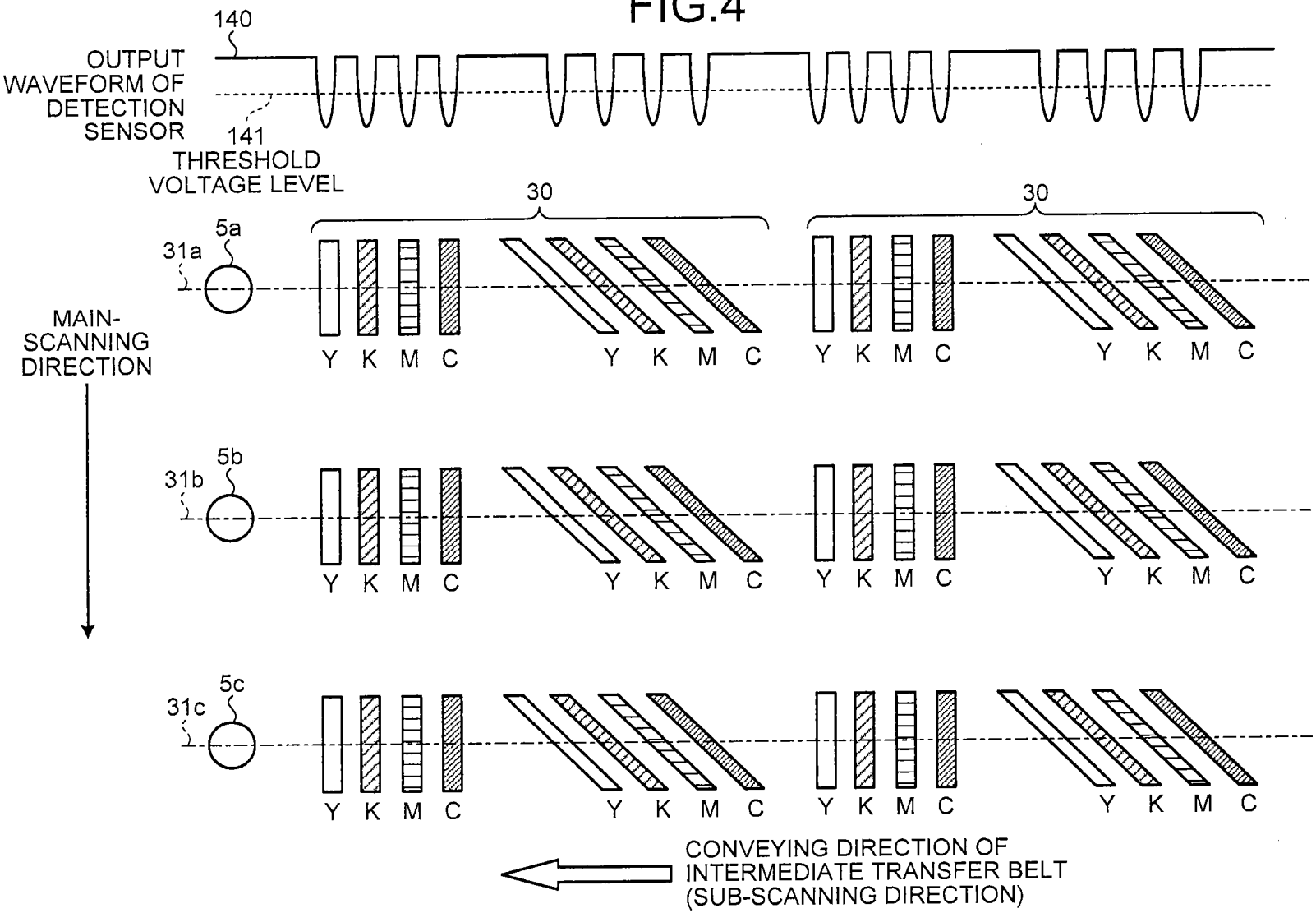
FIG. 4 is a diagram illustrating marks in pattern images for positional deviation correction and a waveform example of a detection signal of the marks detected by the detection sensor.

Next, a case will be described in which pattern images for positional deviation correction are used as the test pattern images. FIG. 4 is a diagram illustrating marks in the pattern images for positional deviation correction and a waveform example of a detection signal of the marks detected by the detection sensor.

The pattern image for positional deviation correction is a collection of predetermined marks for position alignment for specular reflection light, and one set of such marks 30 includes, as illustrated in FIG. 4, a transverse line pattern (also called "horizontal pattern") and a slanted line pattern (also called "slanted pattern") that are formed in the order of Y, K, M, and C. Eight of such marks 30 are arranged in the sub-scanning direction, and three rows of the eight marks 30 are arranged in the main-scanning direction in a manner corresponding to the detection sensors 5*a*, 5*b*, and 5*c*, respectively, thus forming the pattern image for positional deviation correction.

The transverse line pattern is a pattern having four laterally directed lines that are parallel to the main-scanning direction of the photosensitive elements 120*y*, 120*k*, 120*m*, and 120*c*, and each have a predetermined width and a predetermined length. The slanted line pattern is a pattern having four diagonally directed lines each having a predetermined inclination angle with respect to the main-scanning direction of the photosensitive elements 120*y*, 120*k*, 120*m*, and 120*c*, and a predetermined width and a predetermined length. The pattern image for positional deviation correction is formed on the intermediate transfer belt 130 in the arrangement illustrated in FIG. 4 by forming, on the photosensitive elements 120*y*, 120*k*, 120*m*, and 120*c*, the transverse line pattern and the slanted line pattern, with 8 sets and 3 rows, of their corresponding colors Y, K, M, and C, respectively, and by transferring the formed patterns onto the intermediate transfer belt 130.

Long-dashed-short-dashed lines 31*a*, 31*b*, and 31*c* illustrated in FIG. 4 indicate trajectories of centers of the detection sensors 5*a*, 5*b*, and 5*c*, respectively, when the sensors scan in the sub-scanning direction on the intermediate transfer belt 130. FIG. 4 illustrates an example of ideal trajectories obtained when the centers of the detection sensors 5*a*, 5*b*, and 5*c* pass through centers of the pattern image for positional deviation correction.

FIG. 4 illustrates an example in which the transverse line patterns and the slanted line patterns are formed so as to be arranged in the order of Y, K, M, and C from the front in the conveying direction of the intermediate transfer belt 130. However, the order of arrangement of the colors in the transverse line patterns and the slanted line patterns may be other than this order.

The detection sensors 5*a*, 5*b*, and 5*c* arranged in the main-scanning direction respectively detect the three rows of marks in the pattern image for positional deviation correction that is formed on the intermediate transfer belt 130.

A waveform 140 illustrated in FIG. 4 illustrates an example of a change in the detection level (detection signal) when the detection sensor 5*a* detects the marks 30 in the pattern image for positional deviation correction illustrated in FIG. 4. The same waveform is obtained by the other detection sensors 5*b* and 5*c*, and therefore, illustration thereof is omitted.

The detection sensors 5*a*, 5*b*, and 5*c* detect the intermediate transfer belt 130 in a portion other than the transverse line patterns and the slanted line patterns. Therefore, if, for example, the intermediate transfer belt 130 has a white color and the detection level thereon is regarded as a reference level, the detection levels at the transverse line patterns and the slanted line pattern are lower than the reference level.

A threshold voltage level (voltage value) indicated by a dashed line 141 is a threshold value for detecting, as the transverse line pattern or the slanted line pattern, a place where a drop in the detection level exceeds the threshold voltage value, even if the detection level is lowered due to, for example, dirt on the intermediate transfer belt 130.

Each of the detection sensors 5*a*, 5*b*, and 5*c* detects positions of the eight lines of the transverse line pattern and the slanted line pattern in the pattern image for positional deviation correction, and based on the results of the detection, measurement is made of the skews, the main-scanning registration deviation amounts, the sub-scanning registration deviation amounts, and the main-scanning magnification errors of other colors (yellow Y, cyan C, and magenta M) with regard to the reference color (such as black K). Based on these measurement values, deviation amounts are obtained between the center positions of the detection sensors 5*a*, 5*b*, and 5*c* and the center positions of pattern image for positional deviation correction, and stored as positional deviation amounts to be referred to when the pattern image for positional deviation correction is formed next time. Moreover, it is possible to obtain correction values for the various deviation amounts, including the skews, the main-scanning registration deviation amounts, the sub-scanning registration deviation amounts, and the main-scanning magnification errors.

Further, by detecting the three rows of marks with the detection sensors 5*a*, 5*b*, and 5*c*, and calculating a mean value of the detection results, the deviation amounts including the skews, the sub-scanning registration deviations, the main-scanning registration deviations, and the main-scanning magnification errors are obtained from the results of the calculation, and thus, the deviation amounts of each color can be obtained with high accuracy. By correcting the deviation amounts, a high-quality image can be formed with very low deviations of each color.

A well-known correction amount calculating unit (omitted from illustration) commands the execution of calculation of various positional deviation amounts and correction amounts, and execution of correction of the deviations. Then, the pattern image for positional deviation correction after being detected is removed by the cleaning unit 139 of FIG. 1.

Figure 5:
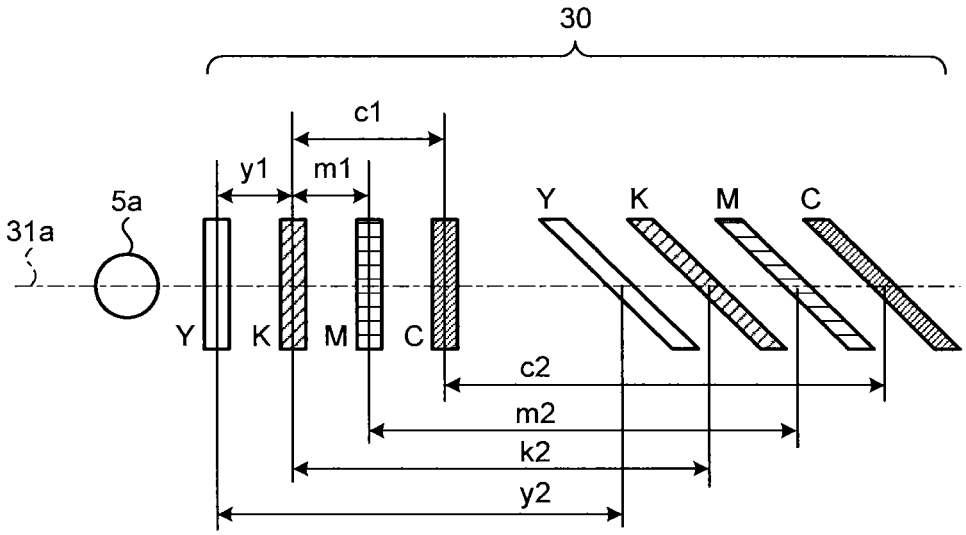
FIG. 5 is a diagram illustrating one set of the marks scanned by the detection sensor.

Using FIG. 5, description will be made of a specific method for calculation of the various positional deviation amounts when the pattern image for positional deviation correction of FIG. 4 is detected. FIG. 5 is a diagram illustrating the detection sensor 5*a* and one set of the marks scanned by the detection sensor 5*a*. Here, although description will be made of a case in which the detection sensor 5*a* detects the marks in the pattern image for positional deviation correction, the same description applies also to the other detection sensors 5*b* and 5*c*.

The detection sensor 5*a* detects the transverse line pattern and the slanted line pattern in the pattern image for positional deviation correction at predetermined constant sampling intervals, and notifies the detected data to the CPU 1 of FIG. 3. The CPU 1 receives in sequence the notifications of detection of the transverse line pattern and the slanted line pattern from the detection sensor 5*a*, and then, based on intervals of the notifications of detection and the sampling time intervals, calculates distances between lines in the transverse line pattern and between each line in the transverse line pattern and each corresponding line in the slanted line pattern. In this manner, the distances between lines in the transverse line pattern and between each line in the transverse line pattern and each corresponding line of the same color in the slanted line pattern are obtained in one set of the marks 30, and the distances thus obtained are compared, thereby enabling to calculate the various positional deviation amounts.

For calculating the sub-scanning registration deviation amounts (color shift amounts in the sub-scanning direction), the transverse line pattern is used. Distance values (yl, ml, and cl) between the reference color (K) and target colors (Y, M, and C), respectively, are calculated, and compared with ideal distance values (y0, m0, and c0) stored in advance. The positional deviation amounts of the target colors (Y, M, and C) relative to the reference color (K) can be calculated from (distance value y1—ideal distance value y0), (distance value m1—ideal distance value m0), and (distance value c1—ideal distance value c0), respectively.

Moreover, for calculating the main-scanning registration deviation amounts (color shift amounts in the main-scanning direction), distance values (y2, k2, m2, and c2) between the lines of the colors K, Y, M, and C in the transverse line pattern and the lines in the slanted line pattern are first calculated. The distance values thus calculated are used to calculate difference values between the distance value of the reference color (K) and the distance values of the non-reference colors. Those difference values correspond to the color shift amounts in the main-scanning direction. This is because that the slanted line pattern is made to be slanted at a predetermined angle relative to the main-scanning direction, and thus, if a deviation occurs in the main-scanning direction, the distance between the slanted line and the transverse line of the reference color is larger or smaller than the corresponding distances of the other colors. Specifically, the positional deviations in the main-scanning direction between black and yellow, between black and magenta, and between black and cyan are obtained from (distance value k2−distance value y2), (distance value k2−distance value m2), and (distance value k2−distance value c2), respectively. In this manner, the registration deviation amounts in the sub-scanning direction and the main-scanning direction can be obtained.

Further, based on differences between detection results of different sensors among the detection sensors 5*a*, 5*b*, and 5*c*, the skews and the main-scanning magnification errors can be obtained. First, the skew components can be obtained by calculating the differences in the sub-scanning registration deviation amounts between those detected by the detection sensor 5*a* and those detected by the detection sensor 5*c*. Moreover, magnification error deviations can be obtained by calculating the differences in the main-scanning registration deviation amounts between those of the detection sensor 5*a* and those of the detection sensor 5*b* and between those of the detection sensor 5*b* and those of the detection sensor 5*c*. Then, based on the various positional deviation amounts obtained as described above, the correction process is executed to correct the image forming conditions used when the color image is formed on the intermediate transfer belt 130.

The correction process is executed, for example, by adjusting light emission timing of the light beams Y, K, M, and C to the photosensitive elements 120*y*, 120*k*, 120*m*, and 120*c* so that the positional deviation amounts almost coincide. Alternatively, the correction process can be executed by adjusting the tilt angles of the reflecting mirrors (omitted from illustration) that reflect the light beams. The tilt angles of the reflecting mirrors are adjusted by driving stepping motors (omitted from illustration). The positional deviation amounts can also be corrected by changing image data. In this manner, the registration deviation amounts in the sub-scanning direction and the main-scanning direction can be obtained.

Figure 6:
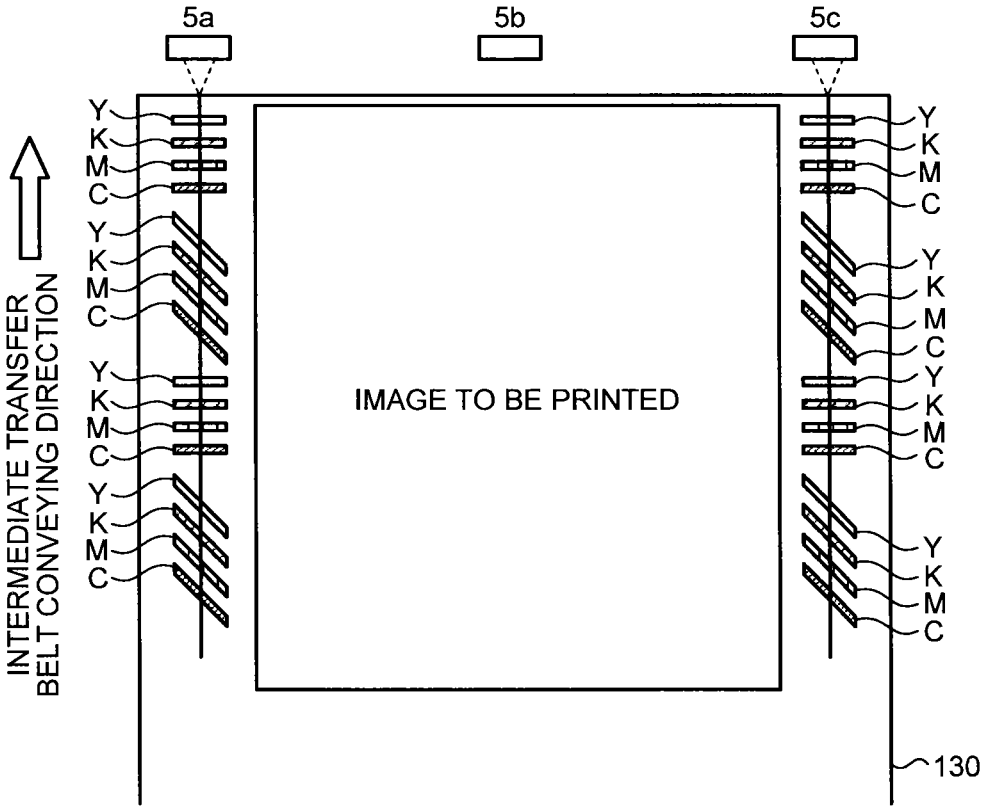
FIG. 6 is a diagram illustrating an intermediate transfer belt and the detection sensors in the case of forming the patterns for correction concurrently with image printing.

FIG. 6 is a diagram illustrating the intermediate transfer belt 130 and the detection sensors 5*a*, 5*b*, and 5*c* in the case of forming the patterns for correction concurrently with image printing. In the case of forming the test patterns for correction concurrently with image printing, it is necessary to arrange one or more of the multiple test pattern detection sensors at one or more outer ends of the image area in the main-scanning direction of a printed image. FIG. 6 illustrates a configuration in which, among the three detection sensors 5*a*, 5*b*, and 5*c*, the detection sensors 5*a* and 5*c* at two locations right and left are arranged at the outer ends of the image area. In image forming apparatuses that do not form the test patterns for correction concurrently with image printing, all of the multiple detection sensors are often arranged in the printed image area to obtain adjusted values in the image area.

Figure 7A:
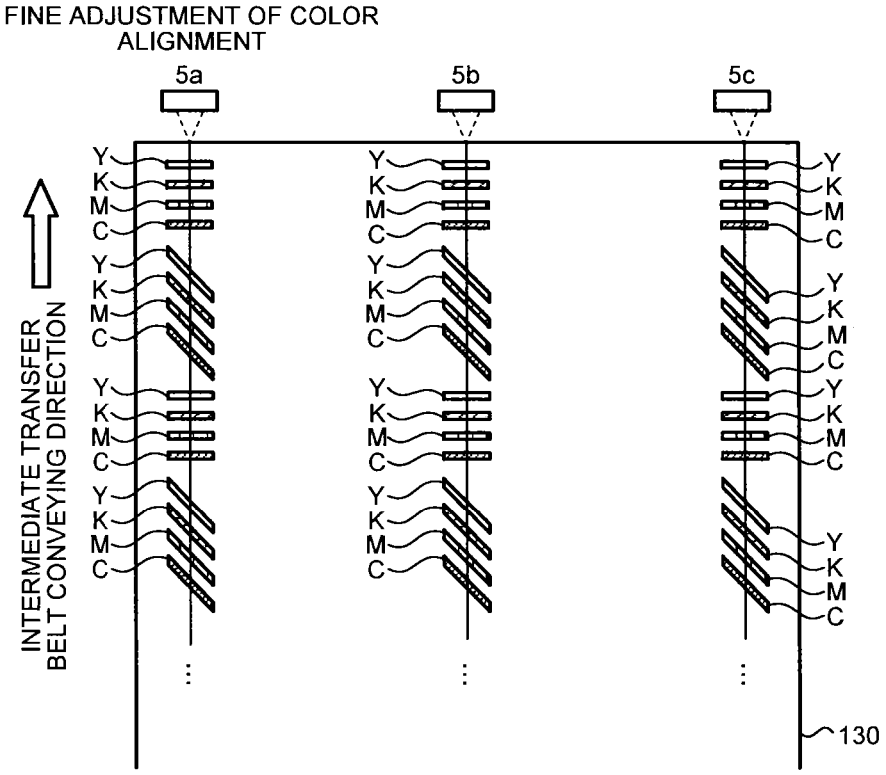
FIG. 7A is a diagram illustrating the intermediate transfer belt formed with the test patterns for correction and the detection sensors.
Figure 7B:
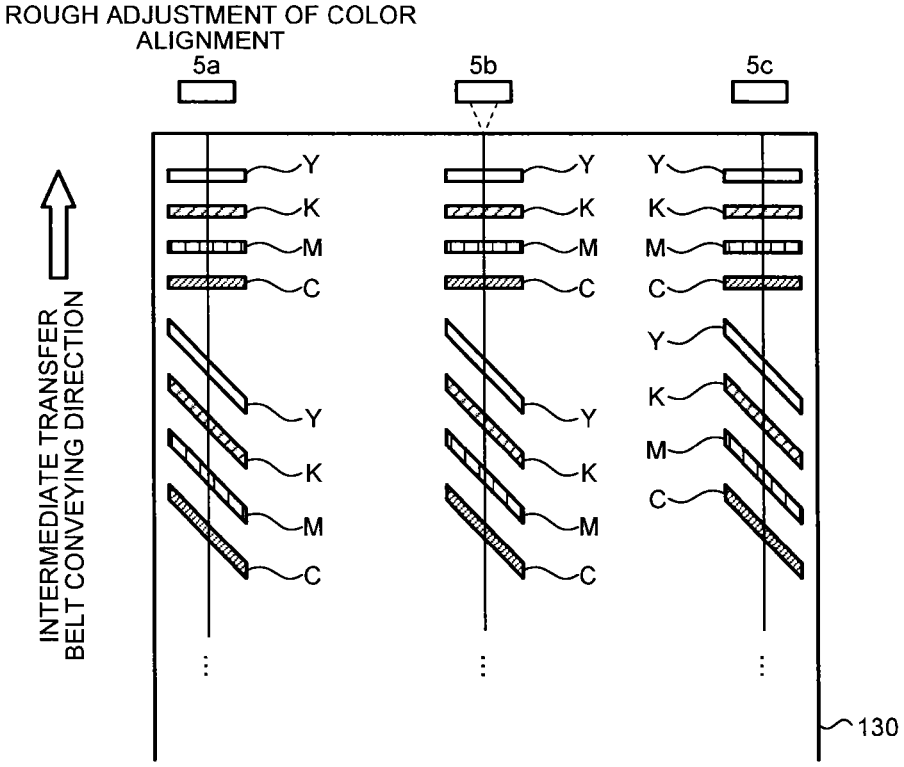
FIG. 7B is a diagram illustrating the intermediate transfer belt formed with the test patterns for correction and the detection sensors.

FIGS. 7A and 7B are diagrams each illustrating the intermediate transfer belt 130 and the detection sensors 5*a*, 5*b*, and 5*c* in the case of changing a width of the test pattern for correction in a main-scanning direction. In some cases, the width of test pattern for correction in the main-scanning direction is changed, for example, when the adjustment is performed. FIGS. 7A and 7B illustrate examples of a fine adjustment and a rough adjustment during color shift correction. The fine adjustment illustrated in FIG. 7A is an adjustment that is performed when a color shift is expected to be small, and aims at correcting the color shift with higher accuracy. In this case, the width of the test pattern to be formed in the main-scanning direction can be made small in accordance with the expected color shift, and the adjustment is performed with high accuracy by forming, with respect to each of the sensors, multiple sets of marks, each set being composed of the lines of the respective colors in the transverse line pattern and the slanted line pattern.

On the other hand, the rough adjustment illustrated in FIG. 7B is performed when a color shift is expected to be large, and aims at, not correcting the color shift with higher accuracy, but adjusting the color shift in a sure manner even when a large color shift occurs. In this case, the width of the pattern to be formed in the main-scanning direction needs to made large in accordance with the expected color shift, and one set, or fewer sets than in the fine adjustment, of marks are formed with respect to each of the sensors, where each set is composed of the lines of the respective colors in the transverse line pattern and the slanted line pattern. Which of the fine adjustment and the rough adjustment is to be performed is determined depending, for example, on a temperature change from a previously performed color shift correction, elapsed time, and on the number of copies.

In the case in which the detection sensors are configured as illustrated in FIG. 6, and the widths of test patterns in the main-scanning direction are changed as illustrated in FIG. 7A or FIG. 7B, there is a possibility that the LDs would emit light outside an optical properties guarantee area that is set for each apparatus. Here, the term "optical properties guarantee area" refers to an area in the main-scanning direction in which a scanning beam is guaranteed to be emitted to a target area of the photosensitive element. Outside this area, lens properties of a scanning optical system are not guaranteed, and when the beam is turned on, exposure of an unintended place occurs. When the unintended exposure occurs in the photosensitive element, the exposure causes occurrence of troubles such as failure in the adjusting operation and image degradation, or, when the unintended exposure occurs in a sensor such as a synchronization detector, the exposure causes occurrence of operational abnormalities.

Figure 8A:
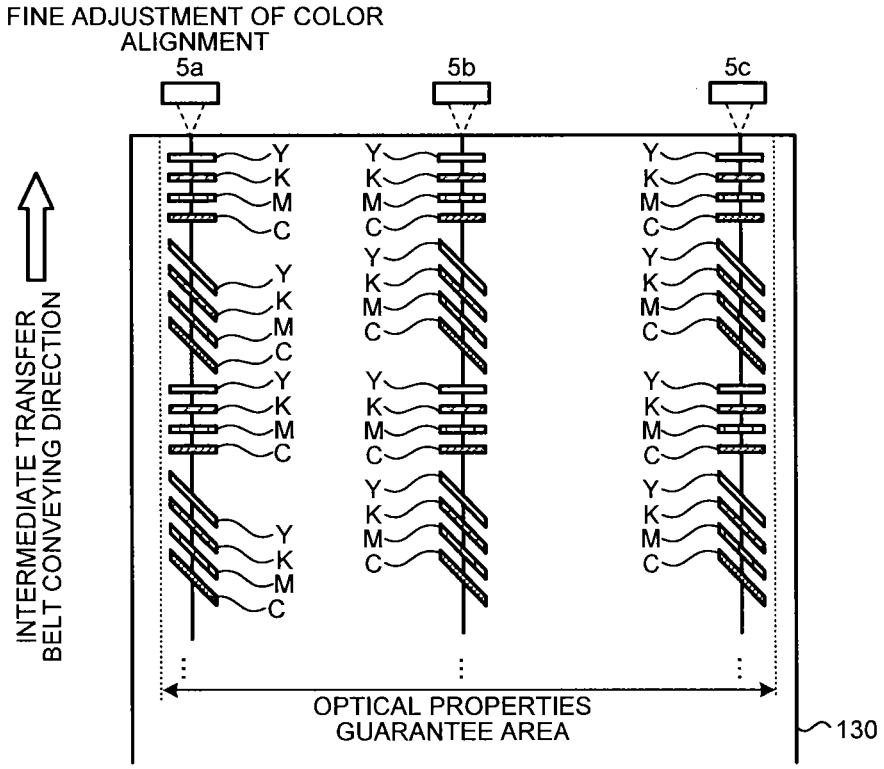
FIG. 8A is a diagram illustrating the intermediate transfer belt formed with the test patterns for correction and the detection sensors.
Figure 8B:
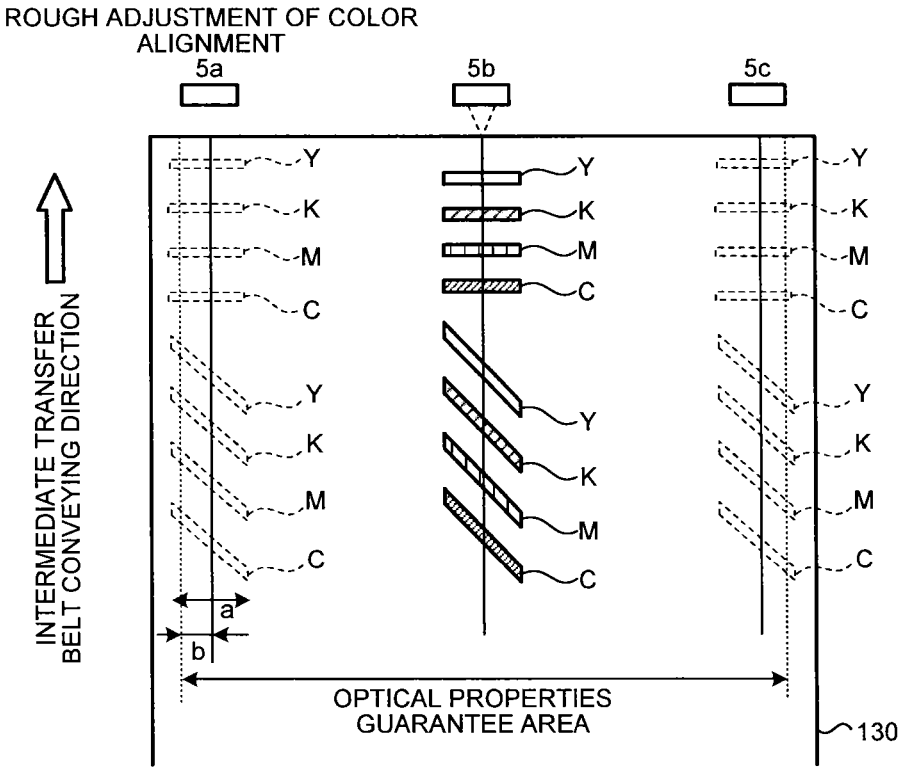
FIG. 8B is a diagram illustrating the intermediate transfer belt formed with the test patterns for correction and the detection sensors.

Therefore, the image forming apparatus of this embodiment changes, depending on the width of the test pattern to be formed in the main-scanning direction, the sensors that detect the test patterns. FIGS. 8A and 8B are diagrams each illustrating the intermediate transfer belt 130 and the detection sensors 5*a*, 5*b*, and 5*c* in the case of changing the widths of the test patterns for correction in the main-scanning direction. In the fine adjustment of the color shift illustrated in FIG. 8A in which the widths of the test patterns in the main-scanning direction are small, the test patterns are formed in positions corresponding to all of the sensors, while, on the other hand, in the rough adjustment of the color shift illustrated in FIG. 8B in which the widths of the test patterns are large, the test patterns extending out of the optical properties guarantee area are not formed.

Here, whether to form the test pattern for each of the detection sensors can be judged based on "width of test pattern in main-scanning direction: a", "distance from center of sensor to end of optical properties guarantee area in main-scanning direction: b", and "expected color shift amount: c". The test pattern is not formed in the position corresponding to the detection sensor if $(a/2+c)\ b$ is satisfied, and is formed there if $(a/2+c)<b$ is satisfied. Here, the "expected color shift amount c" is a maximum expected color shift amount (=a moving amount of the test pattern) during the generation of the test pattern, and is a value determined by multiplying a property of the scanning beam optical system (an amount of change in main-scanning position of exposure beam for 1° C. change) by a temperature change from the previous color shift correction. The number of times of processing required for the judgment can be minimized by applying this judgment only to the detection sensors disposed at both ends in the main-scanning direction.

Figure 9A:
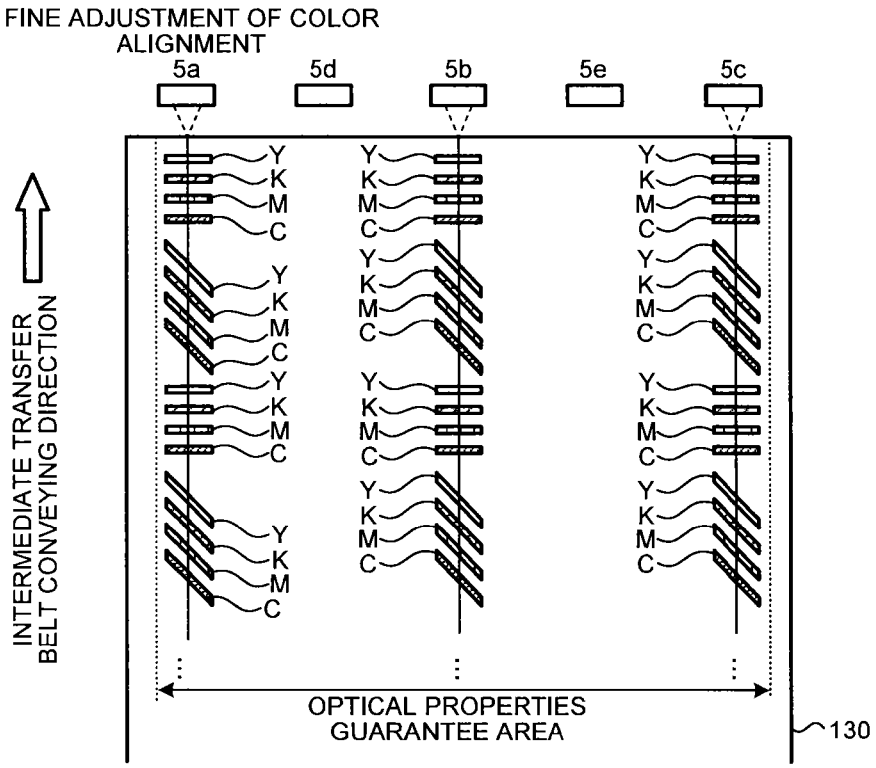
FIG. 9A is a diagram illustrating the intermediate transfer belt formed with the test patterns for correction and the detection sensors.
Figure 9B:
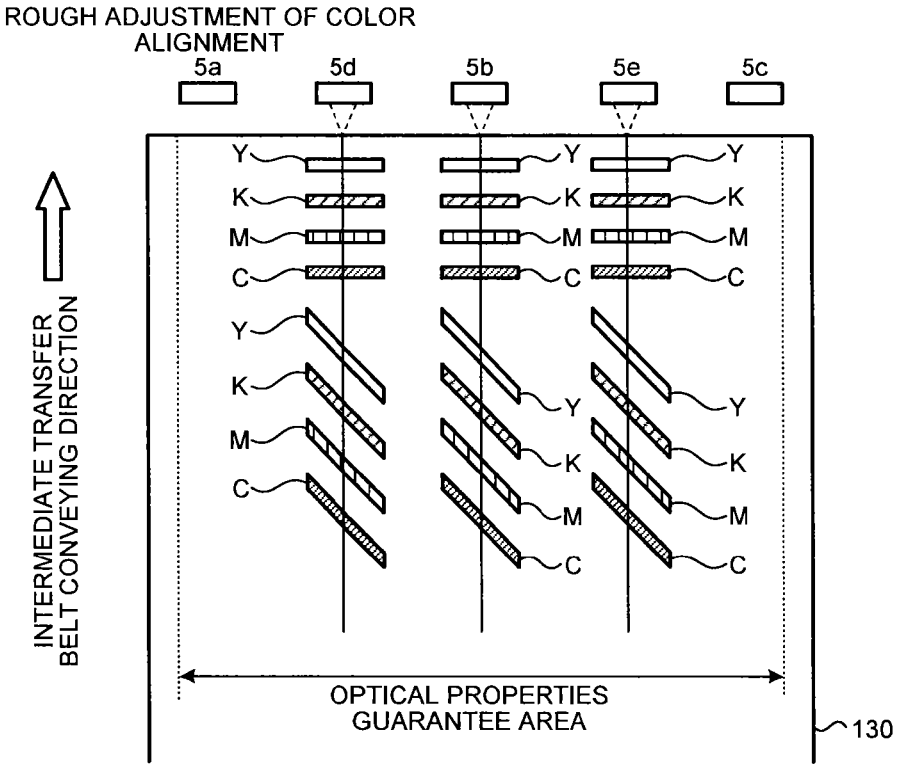
FIG. 9B is a diagram illustrating the intermediate transfer belt formed with the test patterns for correction and the detection sensors.

FIGS. 9A and 9B are diagrams illustrating a modification example of this embodiment in which, when more than three detection sensors are provided, locations at which the test patterns are formed are changed depending on the width of each of the test patterns for correction in the main-scanning direction. In FIGS. 9A and 9B, five detection sensors 5*a*, 5*d*, 5*b*, 5*e*, and 5*c* are arranged from the left to the right in the drawings. During the fine adjustment of the color shift, as illustrated in FIG. 9A, the test patterns are formed in positions corresponding to the detection sensors 5*a*, 5*b*, and 5*c*, whereas during the rough adjustment of the color shift, as illustrated in FIG. 9B, the test patterns are formed in positions corresponding to the detection sensors 5*d*, 5*b*, and 5*e*. Thereby, the LDs can be prevented from emitting light outside the optical properties guarantee area.

Figure 10:
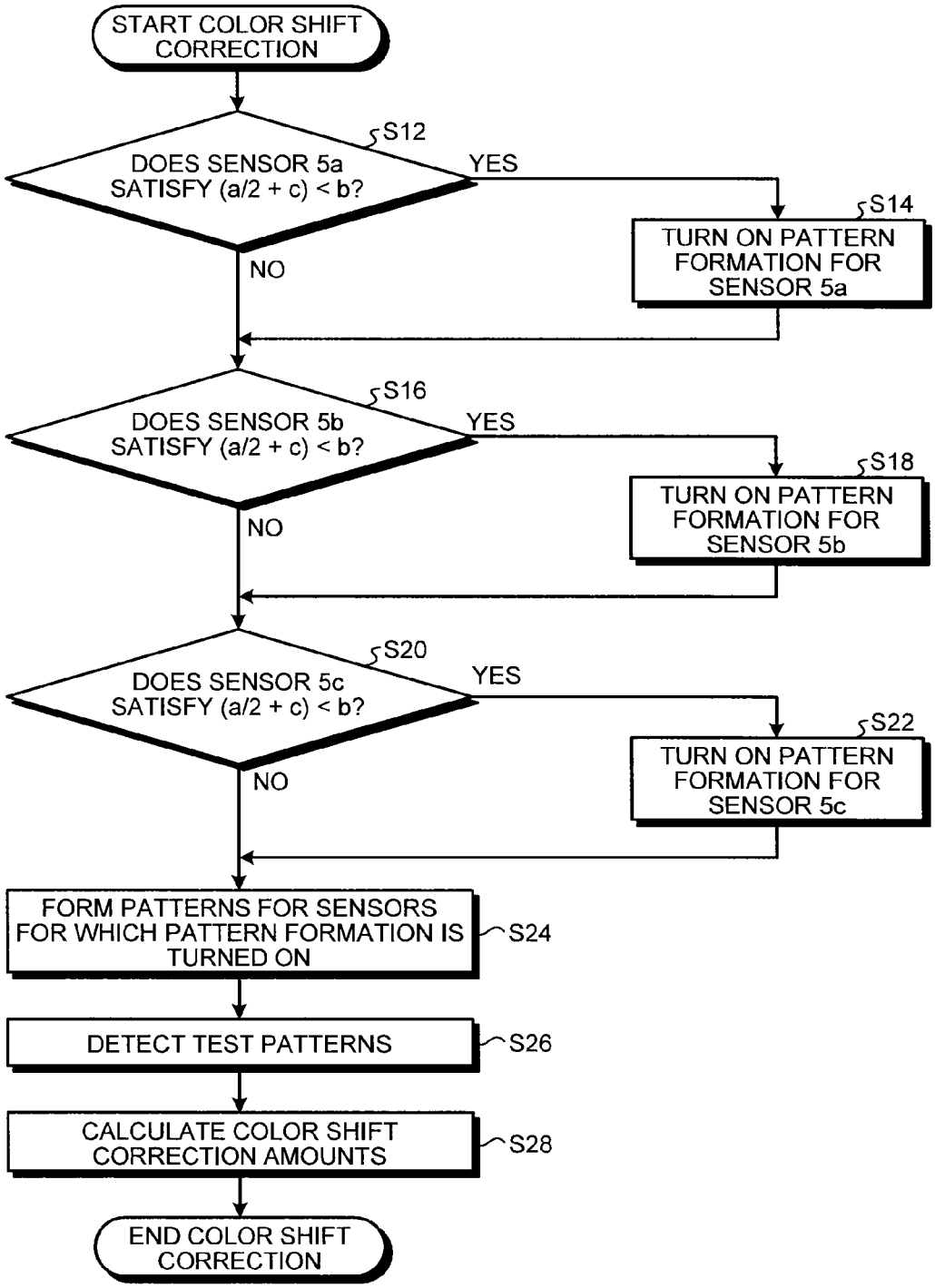
FIG. 10 is a flow chart illustrating a color shift correction process according to the embodiment of the present invention.

FIG. 10 is a flow chart illustrating the color shift correction process according to this embodiment. The CPU 1 judges, as Step S12, whether (a/2+c)<b is satisfied with respect to the detection sensor 5*a*. When it is judged at Step S12 that (a/2+c)<b is satisfied (Yes), the CPU 1, as Step S14, turns on a flag that controls the test pattern formation with respect to the detection sensor 5*a*.

When it is judged at Step S12 that (a/2+c)<b is not satisfied (No) or when having executed Step S14, the CPU 1 judges, as Step S16, whether (a/2+c)<b is satisfied with respect to the detection sensor 5*b*. When it is judged at Step S16 that (a/2+c)<b is satisfied (Yes), the CPU 1, as Step S18, turns on a flag that controls the test pattern formation with respect to the detection sensor 5*b*.

When it is judged at Step S16 that (a/2+c)<b is not satisfied (No) or when having executed Step S18, the CPU 1 judges, as Step S20, whether (a/2+c)<b is satisfied with respect to the detection sensor 5*c*. When it is judged at Step S20 that (a/2+c)<b is satisfied (Yes), the CPU 1, as Step S22, turns on a flag that controls the test pattern formation with respect to the detection sensor 5*c*.

When it is judged at Step S20 that (a/2+c)<b is not satisfied (No) or when having executed Step S22, the CPU 1 forms, as Step S24, the test patterns in the positions corresponding to the detection sensors with respect to which the flags controlling the test pattern formation are turned on. The detection sensors corresponding to the positions in which the test patterns are formed detect the test patterns as Step S26. The CPU 1 calculates, as Step S28, the color shift correction amounts based on the test patterns detected at Step S26.

According to this embodiment, it is possible to determine the widths of the test patterns in the main-scanning direction depending on conditions such as whether the fine adjustment or the rough adjustment, and, depending on a width of the test patterns in the main-scanning direction, to selectively switch whether to form the test pattern in the position corresponding to each of the detection sensors 5*a*, 5*b*, and 5*c*. With this method, the beams are suppressed from being turned on outside the optical properties guarantee area. Accordingly, for example, failure in the adjusting operation, image degradation, and operational abnormalities can be suppressed.

Figure 11:
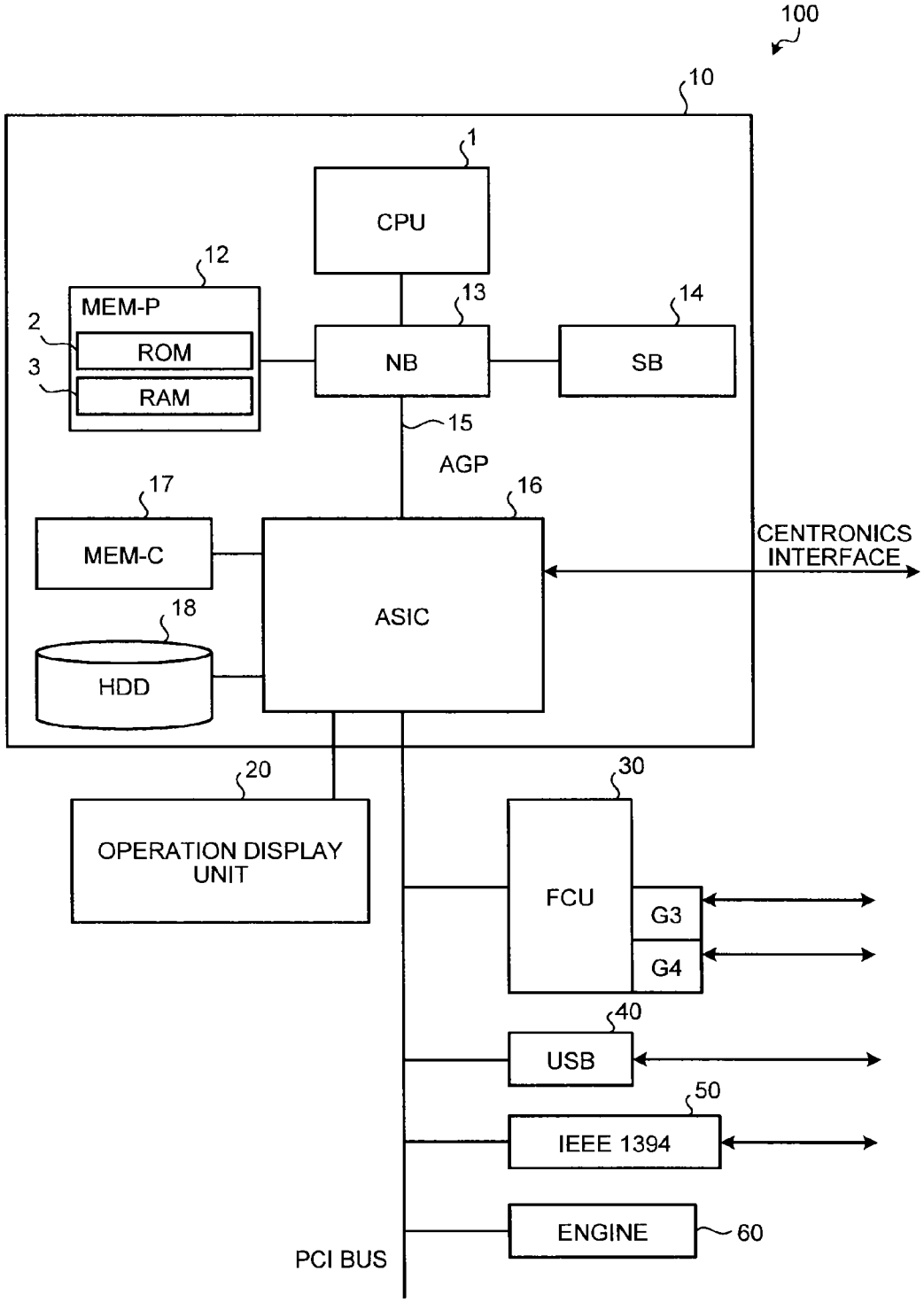
FIG. 11 is a block diagram illustrating a hardware configuration of the image forming apparatus according to the embodiment of the present invention.

FIG. 11 is a block diagram illustrating a hardware configuration of the image forming apparatus according to this embodiment. As illustrated in this diagram, the image forming apparatus 100 has a configuration in which a controller 10 is connected to an engine unit (engine) 60 via a peripheral component interconnect (PCI) bus. The controller 10 controls the entire image forming apparatus 100 and also controls drawing, communication, and input from an operating unit (not illustrated). The engine unit 60 is, for example, a printer engine that is connectable to the PCI bus, and is, for example, a black-and-white plotter, a single-drum color plotter, a four-drum color plotter, a scanner, or a facsimile unit. This engine unit 60 includes, in addition to a so-called engine portion such as a plotter, a unit for image processing such as error diffusion and gamma transform.

The controller 10 includes the CPU 1, a northbridge (NB) 13, a system memory (MEM-P) 12, a southbridge (SB) 14, a local memory (MEM-C) 17, an application-specific integrated circuit (ASIC) 16, and a hard disk drive (HDD) 18, and has a configuration in which an accelerated graphics port (AGP) bus 15 connects between the northbridge (NB) 13 and the ASIC 16. The MEM-P 12 further includes the read-only memory (ROM) 2 and the random access memory (RAM) 3.

The CPU 1 performs overall control of the image forming apparatus 100, and has a chipset composed of the NB 13, the MEM-P 12, and the SB 14. The CPU 1 is connected to other devices via this chipset.

The NB 13 is a bridge for connecting the CPU 1 to the MEM-P 12, the SB 14, and the AGP 15, and has a memory controller that controls read from and write to the MEM-P 12, a PCI master, and an AGP target.

The MEM-P 12 is a system memory that is used, for example, as a memory for storing therein computer programs and data, a memory for loading the programs and the data, and a memory for drawing by a printer, and is composed of the ROM 2 and the RAM 3. The ROM 2 is a read-only memory that is used as the memory for storing therein computer programs and data, and the RAM 3 is a writable and readable memory that is used, for example, as the memory for loading the programs and the data and as the memory for drawing by a printer.

The SB 14 is a bridge for connecting the NB 13 to PCI devices and peripheral devices. The SB 14 is connected to the NB 13 via the PCI bus, to which, for example, a network interface (I/F) unit is also connected.

The ASIC 16 is an integrated circuit (IC) for use in image processing having a hardware component for the image processing, and plays a role as a bridge that connects the AGP 15, the PCI bus, the HDD 18, and the MEM-C 17 to each other. The ASIC 16 is composed of a PCI target, an AGP master, an arbiter (ARB) constituting the core of the ASIC 16, a memory controller that controls the MEM-C 17, a plurality of direct memory access controllers (DMACs) that perform, for example, rotation of image data by using a hardware logic or the like, and a PCI unit that transfers data to and from the engine unit 60 via the PCI bus. A facsimile control unit (FCU) 30, a universal serial bus (USB) 40, and an Institute of Electrical and Electronics Engineers 1394 (IEEE 1394) interface 50 are connected to the ASIC 16 via the PCI bus. An operation display unit 20 is directly connected to the ASIC 16.

The MEM-C 17 is a local memory that is used as an image buffer for copying and a code buffer. The hard disk drive (HDD) 18 is a storage for storing therein image data, computer programs, font data, and forms.

The AGP bus 15 is a bus interface for a graphics accelerator card that has been proposed for accelerating graphics operations. The AGP bus 15 accelerates operations of the graphics accelerator card by directly accessing the MEM-P 12 with high throughput.

The programs executed in the image forming apparatus of the present embodiment are provided by being built into a ROM or the like in advance. The programs executed in the image forming apparatus of the present embodiment may be configured to be provided by being recorded in a computer-readable recording medium such as a CD-ROM, a flexible disk (FD), a CD-R, or a digital versatile disc (DVD) as files in an installable or an executable format.

The programs executed in the image forming apparatus of the present embodiment may alternatively be configured to be provided by being stored on a computer connected to a network such as the Internet and downloaded via the network. The programs executed in the image forming apparatus of the present embodiment may still alternatively be configured to be provided or distributed via a network such as the Internet.

The programs executed in the image forming apparatus of the present embodiment are composed of modules including the units (control units) described above. As actual hardware, the CPU (processor) reads the programs from the ROM and executes the programs, whereby the units are loaded into a main memory and generated therein.

In the above-described embodiment, the example has been described in which the image forming apparatus of the present invention is applied to the MFP that has at least two functions out of a copy function, a printer function, a scanner function, and a facsimile function. However, the present invention can be applied to any image forming apparatus such as a copying machine, a printer, a scanner, and a facsimile apparatus.

According to the present invention, a light source can be suppressed from emitting light outside an optical properties guarantee area. Accordingly, occurrences of failure in an adjusting operation, image degradation, and operational abnormalities can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

image carriers;

a charging unit that charges the image carriers;

an exposing unit that forms latent images on the image carriers;

a developing unit that develops the latent images formed on the image carriers with toners of different colors from each other;

a first transfer unit that forms a color image by superimposing and transferring the latent images developed on the image carriers onto a second image carrier moving in transfer positions facing the image carriers;

a second transfer unit that transfers the latent images transferred to and formed on the second image carrier onto a transfer material;

a test pattern forming unit that forms test patterns on the image carriers to be transferred onto the second image carrier;

a plurality of test pattern detection units that are capable of detecting test patterns transferred onto the second image carrier in a plurality of positions in a main-scanning direction; and a control unit that changes image forming conditions in response to detection results of the plurality of test pattern detection units, wherein the test pattern forming unit, based on a width in the main-scanning direction of at least one test pattern in a group of test patterns yet to be formed, switches between:

forming each test pattern from the group of test patterns yet to be formed in a position corresponding to a test pattern detection unit, and forming selected test patterns from the group of test patterns yet to be formed at least based on respective positions of the selected test patterns in the main-scanning direction, and wherein the test pattern forming unit does not form a respective test pattern from the group of test patterns yet to be formed when $(a/2+c) \geq b$ is satisfied, and forms the respective test pattern when $(a/2+c) < b$ is satisfied, wherein a width in the main-scanning direction of the respective test pattern is a, a distance from a center of a test pattern detection unit corresponding to the respective test pattern to an end of an optical properties guarantee area in the main-scanning direction is b, and an expected color shift amount is c.

2. The image forming apparatus according to claim 1, wherein the test pattern forming unit judges whether to form the respective test pattern with respect to two test pattern detection units arranged at both ends in the main-scanning direction among the plurality of test pattern detection units.

3. The image forming apparatus according to claim 1, wherein the group of test patterns yet to be formed is equal to 3.

4. The image forming apparatus according to claim 3, wherein the formed selected test patterns from the group of test patterns yet to be formed is equal to 8.

5. The image forming apparatus according to claim 1, wherein the formed selected test patterns from the group of test patterns yet to be formed is equal to 8.

6. The image forming apparatus according to claim 1, wherein a number of the group of test patterns yet to be formed is equal to a number of the plurality of test pattern detection units.

7. The image forming apparatus according to claim 1, wherein the expected color shift amount is a maximum expected color shift amount during the formation of the test pattern.

8. An image forming method performed in an image forming apparatus that includes:

image carriers;

a charging unit that charges the image carriers;

an exposing unit that forms latent images on the image carriers;

a developing unit that develops the latent images formed on the image carriers with toners of different colors from each other;

a first transfer unit that forms a color image by superimposing and transferring the latent images developed on the image carriers onto a second image carrier moving in transfer positions facing the image carriers;

a second transfer unit that transfers the latent images transferred to and formed on the second image carrier onto a transfer material;

a test pattern forming unit that forms test patterns on the image carriers to be transferred onto the second image carrier;

a plurality of test pattern detection units that are capable of detecting test patterns transferred onto the second image carrier in a plurality of positions in a main-scanning direction; and a control unit that changes image forming conditions in response to detection results of the plurality of test pattern detection units, the image forming method comprising:

determining a width in the main-scanning direction of at least one test pattern in a group of test patterns yet to be formed;

selecting between a first operation and a second operation of the test pattern forming unit based on the width in the main-scanning direction of the at least one test pattern, wherein in the first operation, the test pattern forming unit forms each test pattern from the group of test patterns yet to be formed in a position corresponding to a test pattern detection unit, and wherein in the second operation, the test pattern forming unit forms selected test patterns from the group of test patterns yet to be formed at least based on respective positions of the selected test patterns in the main-scanning direction; and not forming a respective test pattern from the group of test patterns yet to be formed when $(a/2+c) \geq b$ is satisfied, and forming the respective test pattern when $(a/2+c) < b$ is satisfied, wherein a width in the main-scanning direction of the respective test pattern is a, a distance from a center of a test pattern detection unit corresponding to the respective test pattern to an end of an optical properties guarantee area in the main-scanning direction is b, and an expected color shift amount is c.

9. The image forming method according to claim 8, further comprising:

judging whether to form a respective test pattern with respect to two test pattern detection units arranged at both ends in the main-scanning direction among the plurality of test pattern detection units.

10. The image forming method according to claim 8, wherein a number of the group of test patterns yet to be formed is equal to a number of the plurality of test pattern detection units.

11. A computer program product comprising a non-transitory computer-readable medium including a computer program executed on an image forming apparatus that includes:

image carriers;

a charging unit that charges the image carriers;

an exposing unit that forms latent images on the image carriers;

a developing unit that develops the latent images formed on the image carriers with toners of different colors from each other;

a first transfer unit that forms a color image by superimposing and transferring the latent images developed on the image carriers onto a second image carrier moving in transfer positions facing the image carriers;

a second transfer unit that transfers the latent images transferred to and formed on the second image carrier onto a transfer material;

a test pattern forming unit that forms test patterns on the image carriers to be transferred onto the second image carrier;

a plurality of test pattern detection units that are capable of detecting test patterns transferred onto the second image carrier in a plurality of positions in a main-scanning direction; and a control unit that changes image forming conditions in response to detection results of the plurality of test pattern detection units, wherein the program, when executed on the image forming apparatus, causes the image forming apparatus to perform:

determining a width in the main-scanning direction of at least one test pattern in a group of test patterns yet to be formed;

selecting between a first operation and a second operation of the test pattern forming unit based on the width in the main-scanning direction of the at least one test pattern, wherein in the first operation, the test pattern forming unit forms each test pattern from the group of test patterns yet to be formed in a position corresponding to a test pattern detection unit, and wherein in the second operation, the test pattern forming unit forms a number of selected test patterns from the group of test patterns yet to be formed at least based on respective positions of the selected test patterns in the main-scanning direction; and not forming a respective test pattern from the group of test patterns yet to be formed when $(a/2+c) \geq b$ is satisfied, and forming the respective test pattern when $(a/2+c) < b$ is satisfied, wherein a width in the main-scanning direction of the respective test pattern is a, a distance from a center of a test pattern detection unit corresponding to the respective test pattern to an end of an optical properties guarantee area in the main-scanning direction is b, and an expected color shift amount is c.

12. The computer program product according to claim 11, wherein the computer program further causes the image forming apparatus to judge whether to form a respective test pattern with respect to two test pattern detection units arranged at both ends in the main-scanning direction among the plurality of test pattern detection units.

13. The computer program product according to claim 11, wherein a number of the group of test patterns yet to be formed is equal to a number of the plurality of test pattern detection units.

14. An image forming apparatus comprising:

image carriers;

a charging unit that charges the image carriers;

an exposing unit that forms latent images on the image carriers;

a developing unit that develops the latent images formed on the image carriers with toners of different colors from each other;

a first transfer unit that forms a color image by superimposing and transferring the latent images developed on the image carriers onto a second image carrier moving in transfer positions facing the image carriers;

a second transfer unit that transfers the latent images transferred to and formed on the second image carrier onto a transfer material;

a test pattern forming unit that forms test patterns on the image carriers to be transferred onto the second image carrier;

a plurality of test pattern detection units that are capable of detecting test patterns transferred onto the second image carrier in a plurality of positions in a main-scanning direction; and a control unit that changes image forming conditions in response to detection results of the plurality of test pattern detection units, wherein the test pattern forming unit determines, depending on a width in the main-scanning direction of test patterns yet to be formed, whether to form each of the test patterns yet to be formed in respective positions corresponding to respective test pattern detection units, and wherein the test pattern forming unit does not form a test pattern in a position corresponding to one of the plurality of test pattern detection units when $(a/2+c) \geq b$ is satisfied, and forms the test pattern in the position corresponding to the one of the plurality of test pattern detection units when $(a/2+c) < b$ is satisfied, wherein a width of the test pattern in the main-scanning direction is a, a distance from a center of the one of the plurality of test pattern detection units to an end of an optical properties guarantee area in the main-scanning direction is b, and an expected color shift amount is c.

* * * * *